United States Patent [19]

Griffiths

[11] 4,383,503

[45] May 17, 1983

[54] COMBUSTION CHAMBER SCAVENGING SYSTEM

[75] Inventor: John M. Griffiths, Fond du Lac, Wis.

[73] Assignee: Brunswick Corporation, Skokie, Ill.

[21] Appl. No.: 273,129

[22] Filed: Jun. 12, 1981

[51] Int. Cl.[3] ..... F02B 33/04

[52] U.S. Cl. ..... 123/73 PP; 123/73 AB; 123/73 A

[58] Field of Search ..... 123/73 AB, 73 AA, 73 BA, 123/73 PP, DIG. 12

[56] References Cited

U.S. PATENT DOCUMENTS

| | | | |
|---|---|---|---|
| 632,913 | 9/1899 | Burger | 123/73 AB |
| 796,686 | 8/1905 | Westendarp | 123/73 AB |
| 978,969 | 12/1910 | Webber | 123/73 AB |
| 1,046,738 | 12/1912 | Cross | 123/73 AB |
| 1,101,374 | 6/1914 | Woolery | 123/73 AB |
| 2,682,259 | 6/1959 | Watkins | 123/DIG. 2 |
| 3,730,149 | 5/1973 | Brown | 123/DIG. 2 |
| 3,929,111 | 12/1975 | Turner et al. | 123/73 PP |

FOREIGN PATENT DOCUMENTS

| | | | |
|---|---|---|---|
| 797320 | 2/1936 | France | 123/73 BA |
| 97306 | 1/1923 | Switzerland | 123/73 AB |

*Primary Examiner*—Wendell E. Burns
*Attorney, Agent, or Firm*—O. T. Sessions

[57] ABSTRACT

A two cycle engine having piston controlled inlet and exhaust ports is provided with a secondary one-way valved air fuel mixture passage to the combustion chamber adjacent the spark plug.

1 Claim, 3 Drawing Figures

COMBUSTION CHAMBER SCAVENGING SYSTEM

TECHNICAL FIELD

This invention relates to internal combustion engines and, more particularly, to scavenging systems for two-cycle engines.

BACKGROUND ART

Two-cycle internal combustion engines have been improved to increase horsepower and fuel economy by improvements in the scavenging system. These improvements have been made at the cost of increased engine roughness at low speed and idle.

DISCLOSURE OF INVENTION

This invention provides a spark-ignition two-cycle engine having piston controlled inlet and exhaust ports wherein a secondary passage is provided to supply additional air-fuel mixture to the combustion chamber adjacent the spark plug. This arrangement substantially improves the engine's idle and low speed qualities, apparently by assuring a combustible mixture adjacent the spark plug.

A one-way valve may be provided to prevent flow from the combustion chamber to the source of the air-fuel mixture.

The invention is particularly suitable for use with a crankcase compression engine wherein the crankcase can supply air-fuel mixture to both the inlet port and the secondary inlet passage. By connecting the secondary passage to a low point in the crankcase or transfer passage the system may simultaneously serve to reduce any problems resulting from puddling of condensed fuel in the system.

Preferably the secondary passage is oriented to direct air-fuel mixture toward the exhaust port.

The invention is particularly suitable for use in two-cycle engines having transfer passages arranged to provide a loop charging flow pattern and wherein the engine has a generally horizontal cylinder.

BEST MODE FOR CARRYING OUT THE INVENTION

Figure 1:
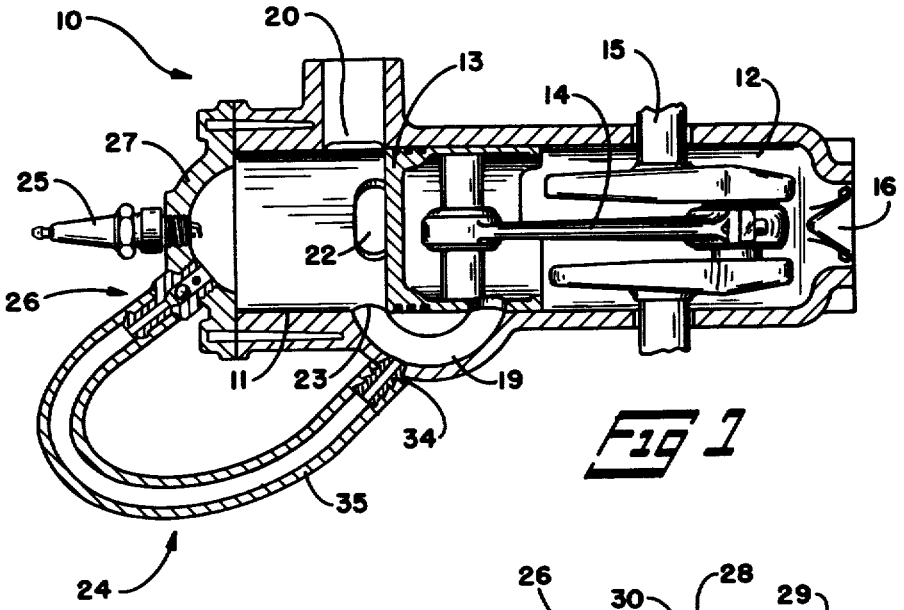
FIG. 1 is a schematic sectional view of an engine in accordance with the invention.

Shown in FIG. 1 of the drawings is a two-cycle, crankcase compression engine 10 having a horizontal cylinder 11 and a crankcase 12. A piston 13 mounted in the cylinder 11 is connected by a rod 14 to a crankshaft 15 journalled for rotation about a generally vertical axis in the crankcase 12. The engine 10 includes a generally conventional carburetor, not illustrated, for supplying a carbureted mixture of gasoline, lubricant, and air to the engine crankcase 12 through reed valves 16 mounted on the crankcase 12.

Figure 3:
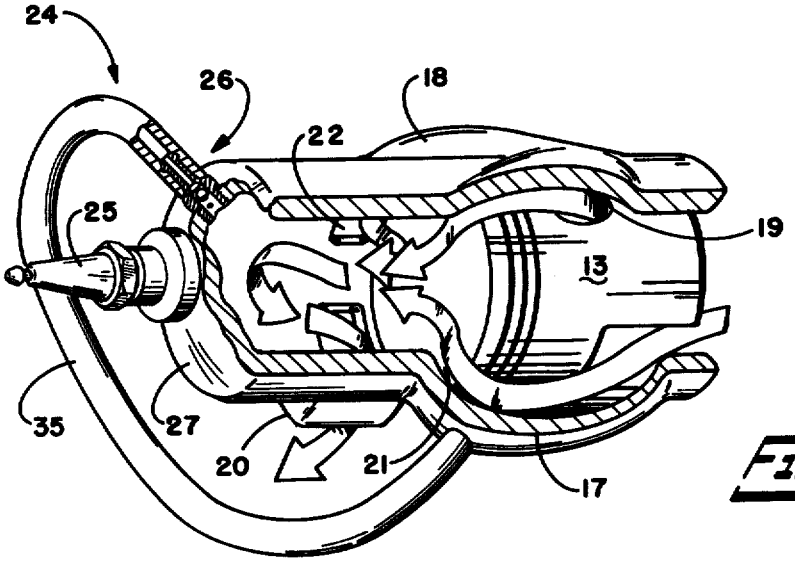
FIG. 3 is a perspective view, partially in section, of the engine cylinder of FIG. 1.

In the preferred embodiment the transfer passages 17, 18, and 19 for transferring the fuel mixture to the engine cylinder 11 and the exhaust port 20 for exhausting combustion gases are arranged as shown in FIG. 3. The three transfer passages include two main passages 17 and 18 and an auxiliary passage 19 which discharge through transfer ports 21, 22, and 23 in the cylinder walls to provide a loop charging flow as illustrated by the arrows in FIG. 3.

Figure 2:
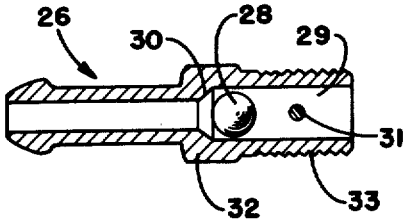
FIG. 2 is an enlarged sectional view of the valve used in the engine of FIG. 1.

A secondary passage 24 is provided to assure the presence of fuel near the spark plug 25 for ignition and to remove any liquid fuel which may accumulate in the lower transfer passage, the auxiliary passage 19 in FIG. 1 or the main passage 17 in FIG. 3. The secondary passage 24 includes a one-way or check valve 26 mounted on the cylinder head 27 to prevent reverse flow in the secondary passage 24. The check valve 26, most clearly illustrated in FIG. 2, includes a stainless steel ball valve member 28 in a valve chamber 29 defined between a conical valve seat 30 and a valve stop 31. The valve stop 31 is a stainless steel bar pressed through the sides of the valve body 32 and serves to retain the valve ball 28 within the valve chamber 29. Screw threads 33 on the valve body 32 engage a threaded passage on the cylinder head 27 to mount the valve body 32 on the head. A fitting 34 is provided at a low point on the bottom transfer passage and a tube 35 between the valve body 32 and the fitting 34 places the lower transfer passage in fluid communication with the valve chamber 29. Of course, the secondary passage 24 could be formed as an integral part of the cylinder block.

In operation, as the piston 13 moves toward the cylinder head 27 the mixture in the cylinder 11 is compressed forcing the valve ball 28 against the valve seat 30. Simultaneously a vacuum is created in the crankcase 12 which draws fresh fuel mixture into the crankcase 12 through the reed valves 16. As the piston 13 nears the head 27 the spark plug 25 ignites the fuel mixture in the cylinder 11 substantially increasing the pressure in the cylinder 11 and driving the piston 13 toward the crankcase 12, compressing the mixture in the crankcase 12. Because of the increased pressure in the cylinder 11 the valve 26 will remain closed until after the piston 13 uncovers the exhaust port 20 to release the combustion gases. With the exhaust port 20 open, cylinder pressure rapidly drops below that in the crankcase 12 and charging flow begins, first through the secondary passage 24 and then through the transfer passages 17, 18, and 19.

The transfer passages produce the characteristic loop charging flow shown by the arrows in FIG. 3, scavenging the cylinder and forcing the exhaust gases out the exhaust port 20. At low speeds, however, the charging flow introduced through the transfer ports is relatively slow and apparently does not fully purge the cylinder 11 of combustion gases, occasionally leaving a pocket of mixture near the spark plug 25 which is too lean to ignite.

The present invention remedies the foregoing problem by introducing additional fuel mixture from the transfer port to the cylinder 11 adjacent the spark plug 25, with the check valve 26 in the secondary passage 24 opening after the exhaust port 20 opens but before the transfer ports open. Preferably the mixture introduced through the check valve 26 is directed generally in the direction of the exhaust port 20 to further aid scavenging of the cylinder 11. The secondary passage 24 is sized to produce little effect at high speeds where it is not needed.

The invention thus provides a two-cycle engine having substantially improved performance at low and idle speeds.

I claim:

1. A two-cycle, crankcase compression engine comprising:

(A) a generally horizontal cylinder;

(B) a piston mounted for reciprocation in said cylinder and defining a variable volume combustion chamber in one end of said cylinder;

(C) a crankcase chamber at the other end of said cylinder having a volume which varies as said piston reciprocates;

(D) a transfer passage means formed in the walls of said cylinder for transferring air-fuel mixture from said crankcase chamber to said combustion chamber and creating a loop charging flow pattern in said combustion chamber;

(E) a spark plug in said combustion chamber for igniting said air-fuel mixture;

(F) an exhaust port in said combustion chamber for exhausting combustion gases from said combustion chamber; and (G) a secondary passage connecting a low point in said transfer passage means where liquid fuel may accumulate to said combustion chamber adjacent said spark plug to admit fuel or air-fuel mixture to said combustion chamber directed toward said exhaust port, said secondary passage including a one-way valve to prevent flow from said combustion chamber.

* * * * *